US011898562B2

(12) United States Patent
Hu et al.

(10) Patent No.: US 11,898,562 B2
(45) Date of Patent: Feb. 13, 2024

(54) PUMPING ASSEMBLY, COMPRESSOR AND AIR CONDITIONING EQUIPMENT

(71) Applicant: GREE ELECTRIC APPLIANCES, INC. OF ZHUHAI, Zhuhai (CN)

(72) Inventors: Yusheng Hu, Zhuhai (CN); Huijun Wei, Zhuhai (CN); Jia Xu, Zhuhai (CN); Liying Deng, Zhuhai (CN); Guomang Yang, Zhuhai (CN); Shebing Liang, Zhuhai (CN); Pengkai Wan, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 396 days.

(21) Appl. No.: 17/299,600

(22) PCT Filed: Oct. 31, 2019

(86) PCT No.: PCT/CN2019/114735
§ 371 (c)(1),
(2) Date: Jun. 3, 2021

(87) PCT Pub. No.: WO2020/173118
PCT Pub. Date: Sep. 3, 2020

(65) Prior Publication Data

US 2022/0034323 A1 Feb. 3, 2022

(30) Foreign Application Priority Data

Feb. 27, 2019 (CN) ..... 201910147053.9

(51) Int. Cl.
*F04C 29/02* (2006.01)
*F04C 18/344* (2006.01)
(Continued)

(52) U.S. Cl.
CPC ..... *F04C 29/028* (2013.01); *F01C 21/106* (2013.01); *F04C 18/344* (2013.01);
(Continued)

(58) Field of Classification Search
CPC .... F04C 29/028; F04C 18/344; F04C 29/023; F04C 29/04; F04C 18/3441; F04C 2240/50; F04C 2240/603; F01C 21/106
See application file for complete search history.

(56) References Cited

U.S. PATENT DOCUMENTS 5,954,482 A 9/1999 Ijiri et al.
2014/0294642 A1* 10/2014 Sekiya ..... F04C 18/3441 418/55.1
2015/0252806 A1 9/2015 Nakazawa et al.

FOREIGN PATENT DOCUMENTS

CN 100419269 C 9/2008
CN 102667162 A 9/2012
(Continued)

OTHER PUBLICATIONS

CN205677829 translation (Year: 2023).*
(Continued)

*Primary Examiner* — Kenneth J Hansen
*Assistant Examiner* — David N Brandt
(74) *Attorney, Agent, or Firm* — Oblon, McClelland, Maier & Neustadt, L.L.P.

(57) ABSTRACT

The present disclosure provides a pumping assembly, a compressor and air conditioning equipment. The pumping assembly includes a first structural body, a rolling bearing assembly, a second structural body, a third structural body and a main shaft passing through the first structural body, the rolling bearing assembly, the second structural body and the third structural body. The pumping assembly includes: a first lubricating oil path passing through a second structural part,
(Continued)

the sliding sheet backpressure cavity, a third structural part, a second structural part and a rolling body of the rolling bearing assembly; a second lubricating oil path passing through the sliding sheet backpressure cavity and a first pressure relieving groove of the first structural body; and a third lubricating oil path passing through the sliding sheet backpressure cavity, the first structural part and the rolling body of the rolling bearing assembly.

17 Claims, 7 Drawing Sheets

(51) Int. Cl.
*F04C 29/04* (2006.01)
*F01C 21/10* (2006.01)

(52) U.S. Cl.
CPC ..... *F04C 29/023* (2013.01); *F04C 29/04* (2013.01); *F04C 2240/50* (2013.01); *F04C 2240/603* (2013.01)

(56) References Cited

FOREIGN PATENT DOCUMENTS

| | | | | | |
|---|---|---|---|---|---|
| CN | 104373349 | A | | 2/2015 | |
| CN | 105402125 | A | | 3/2016 | |
| CN | 205154626 | U | | 4/2016 | |
| CN | 105952642 | | * | 9/2016 | ..... F04C 18/344 |
| CN | 105952642 | A | | 9/2016 | |
| CN | 205677829 | | * | 11/2016 | ..... F04C 18/344 |
| CN | 106321443 | A | | 1/2017 | |
| CN | 205918605 | U | | 2/2017 | |
| CN | 106704184 | A | | 5/2017 | |
| CN | 107013456 | A | | 8/2017 | |
| CN | 104895787 | B | | 11/2017 | |
| CN | 105736369 | B | | 12/2017 | |
| CN | 107524600 | | * | 12/2017 | ..... F04C 18/344 |
| CN | 107701447 | A | | 2/2018 | |
| CN | 105909522 | B | | 3/2018 | |
| CN | 107882728 | A | | 4/2018 | |
| CN | 108087270 | A | | 5/2018 | |
| CN | 207349078 | U | | 5/2018 | |
| CN | 207363876 | U | | 5/2018 | |
| CN | 108397383 | A | | 8/2018 | |
| CN | 108825663 | A | | 11/2018 | |
| CN | 108869285 | A | | 11/2018 | |
| CN | 10893651 | A | | 12/2018 | |
| CN | 109737065 | A | | 5/2019 | |
| CN | 210033845 | U | | 2/2020 | |
| EP | 0 761 975 | A1 | | 3/1997 | |

OTHER PUBLICATIONS

CN105952642 translation (Year: 2023).*
CN107524600 translation (Year: 2023).*
International Search Report dated Jan. 31, 2020 in PCT/CN2019/114735 filed Oct. 31, 2019, 3 pages.
The Supplementary European Search Report dated Apr. 19, 2022 in European Patent Application 19916656.2, 1 page.
Extended European Search Report dated Mar. 29, 2022 in European Patent Application 19916656.2, 4 pages.
Chinese Office Action and Search Report issued in Chinese Patent Application No. 201910147053.9 dated Oct. 11, 2023, (w/ English Translation).

* cited by examiner

PUMPING ASSEMBLY, COMPRESSOR AND AIR CONDITIONING EQUIPMENT

RELATED APPLICATION

The present disclosure is based upon and claims priority to Chinese Patent Application No. 201910147053.9, filed on Feb. 27, 2019, and titled "PUMPING ASSEMBLY, COMPRESSOR AND AIR CONDITIONING EQUIPMENT", the entire contents of all of which are incorporated herein by reference.

TECHNICAL FIELD

The present disclosure relates to the technical field of compression equipment, in particular to a pumping assembly, a compressor and air conditioning equipment.

BACKGROUND

On one hand, an oil path of a rotary vane compressor should ensure the lubrication of friction pairs, and on the other hand, the special structure of the rotary vane compressor needs to provide backpressure to the moving vane through the oil path so as to prevent the vane from separating from the cylinder. Therefore, the oil path design and the oil distribution of the rotary vane compressor are particularly important to the comprehensive performance of the compressor.

At present, the rotary vane compressor still has some defects. Due to the limitation of the flange, heat generated by the movement of a bearing rolling body on a raceway is difficult to dissipate, and poor heat dissipation will result in that suction gas of the compressor is heated so as to affect the performance of the compressor. The lubrication of the bearing is realized simply by the leakage of oil carried by gas in the pump body cavity into the bearing raceway; therefore, the amount of the lubricating oil in the bearing raceway is too small to lead to poor lubrication and serious heating of the bearing, thereby resulting in bearing failure.

It can be seen from the above description that there is a problem in the prior art that the lubricating oil path of the pumping assembly cannot meet the lubrication requirement of the pump body.

SUMMARY

A main objective of the present disclosure is to provide a pumping assembly, a compressor and air conditioning equipment, so as to solve the problem in the prior art that the lubricating oil path in the pumping assembly cannot meet the lubrication requirement of the pump body.

To achieve the above objective, according to one aspect of the present disclosure, a pumping assembly is provided. The pumping assembly includes a first structural body, a rolling bearing assembly, a second structural body, a third structural body and a main shaft, wherein the main shaft sequentially passes through the first structural body, the rolling bearing assembly, the second structural body and the third structural body. The pumping assembly includes a plurality of lubricating oil paths which at least include: a first lubricating oil path, a second lubricating oil path and a third lubricating oil path, wherein the first lubricating oil path passes through a second structural part, a sliding sheet backpressure cavity of a rotor structure of the main shaft, a third structural part, a second structural part and a rolling body of the rolling bearing assembly; the second lubricating oil path passes through the sliding sheet backpressure cavity of the rotor structure of the main shaft and a first pressure relieving groove of the first structural body; and the third lubricating oil path passes through the sliding sheet backpressure cavity of the rotor structure of the main shaft, the first structural part and the rolling body of the rolling bearing assembly.

In some embodiments, the first lubricating oil path includes a main shaft center hole of the main shaft, a main shaft oil hole of the main shaft, a second structural body backpressure groove of the second structural body, the sliding sheet backpressure cavity of the rotor structure of the main shaft, a second structural body pressure relieving groove of the second structural body, a second structural body first oil groove of the second structural body, a third structural body first oil hole of the third structural body, a third structural body second oil hole of the third structural body, a second structural body oil hole of the second structural body, the rolling body of the rolling bearing assembly, a second structural body second oil groove of the second structural body, an outer ring oil hole of the rolling bearing assembly and a first structural body first oil hole of the first structural body, wherein the first structural body first oil hole is configured to allow lubricating oil in the first lubricating oil path return to an oil pool.

In some embodiments, the second lubricating oil path includes the main shaft center hole of the main shaft, a main shaft oil hole of the main shaft, a second structural body backpressure groove of the second structural body, the sliding sheet backpressure cavity of the rotor structure of the main shaft, a first structural body backpressure groove of the first structural body, a first structural body pressure relieving groove of the first structural body and a spiral groove of the first structural body, wherein the spiral groove is configured to allow lubricating oil in the second lubricating oil path to return to an oil pool.

In some embodiments, the third lubricating oil includes a main shaft center hole of the main shaft, a main shaft oil hole of the main shaft, a second structural body backpressure groove of the second structural body, the sliding sheet backpressure cavity of the rotor structure of the main shaft, a first structural body backpressure groove of the first structural body, a first structural body second oil hole of the first structural body, a first structural body third oil hole of the first structural body, the rolling body of the rolling bearing assembly, a second structural body second oil groove of the second structural body, an outer ring oil hole of the rolling bearing assembly and a first structural body first oil hole of the first structural body, wherein the first structural body first oil hole is configured to lubricating oil in the third lubricating oil path return to an oil pool.

In some embodiments, the first structural body is located above the rolling bearing assembly, and the second structural body and the third structural body are located below the rolling bearing assembly; or the first structural body is located below the rolling bearing assembly, and the second structural body and the third structural body are located above the rolling bearing assembly.

In some embodiments, the first structural body is an upper flange, the second structural body is a lower flange, and the third structural body is a cover plate.

In some embodiments, a relationship between a diameter d0 of the main shaft and a diameter d1 of the main shaft center hole of the main shaft satisfies:

$$0.2d0 \leq d1 \leq 0.5d0.$$

In some embodiments, a relationship between a diameter d2 of the main shaft oil hole of the main shaft and a diameter d1 of the main shaft center hole of the main shaft satisfies: $0.15d1 \leq d2 \leq 0.6d1$.

In some embodiments, a relationship among a diameter d1 of the main shaft center hole of the main shaft, a diameter d3 of the third structural body first oil hole of the third structural body, a diameter d4 of the third structural second oil hole of the third structural body and a diameter d5 of the second structural body oil hole of the second structural body satisfies: $0.1d1 \leq d3 \leq d4 \leq d5 \leq 0.3d1$.

In some embodiments, a relationship among a diameter d2 of the main shaft oil hole of the main shaft, a diameter d6 of the first structural body second oil hole of the first structural body and a diameter d7 of the first structural body third oil hole of the first structural body satisfies: $0.3d2 \leq d6 \leq d7 \leq d2$.

In some embodiments, a relationship among a diameter d3 of the third structural body first oil hole of the third structural body, a diameter d7 of the first structural body third oil hole of the first structural body and a diameter d8 of the first structural body first oil hole of the first structural body satisfies:

$$0.125(d3^2+d7^2)^{0.5} \leq d8 \leq (d3^2+d7^2)^{0.5}.$$

According to another aspect of the present disclosure, a compressor is provided. The compressor includes the above pumping assembly.

According to another aspect of the present disclosure, air conditioning equipment is provided. The air conditioning equipment includes the above compressor.

By application of the technical solution of the present invention, the pumping assembly in the present invention includes a first structural body, a rolling bearing assembly, a second structural body, a third structural body and a main shaft, wherein the main shaft sequentially passes through the first structural body, the rolling bearing assembly, the second structural body and the third structural body. The pumping assembly includes a plurality of lubricating oil paths which at least include: a first lubricating oil path, a second lubricating oil path and a third lubricating oil path, wherein the first lubricating oil path passes through a second structural part, a sliding sheet backpressure cavity of a rotor structure of the main shaft, a third structural part, a second structural part and a rolling body of the rolling bearing assembly; the second lubricating oil path passes through the sliding sheet backpressure cavity of the rotor structure of the main shaft and a first structural body pressure relieving groove of the first structural body; and the third lubricating oil path passes through the sliding sheet backpressure cavity of the rotor structure of the main shaft, the first structural part and the rolling body of the rolling bearing assembly.

When the pumping assembly with the above structure is used, the rolling bearing assembly is arranged between the first structural body and the second structural body, and lubricating oil paths capable of communicating the first structural body, the rolling bearing assembly, the second structural body and the third structural body are provided respectively, so that the lubrication and heat dissipation requirements of the pump body can be effectively met. Meanwhile, this arrangement also can provide stable backpressure to meet the lubrication requirements of various friction pairs.

BRIEF DESCRIPTION OF THE DRAWINGS

The accompany drawings of the specification constituting a part of the present disclosure provide further understanding of the present disclosure. The schematic embodiments of the present disclosure and description thereof are intended to be illustrative of the present disclosure and do not constitute an undue limitation of the present disclosure. In the accompanying drawings.

DETAILED DESCRIPTION

Figure 1:
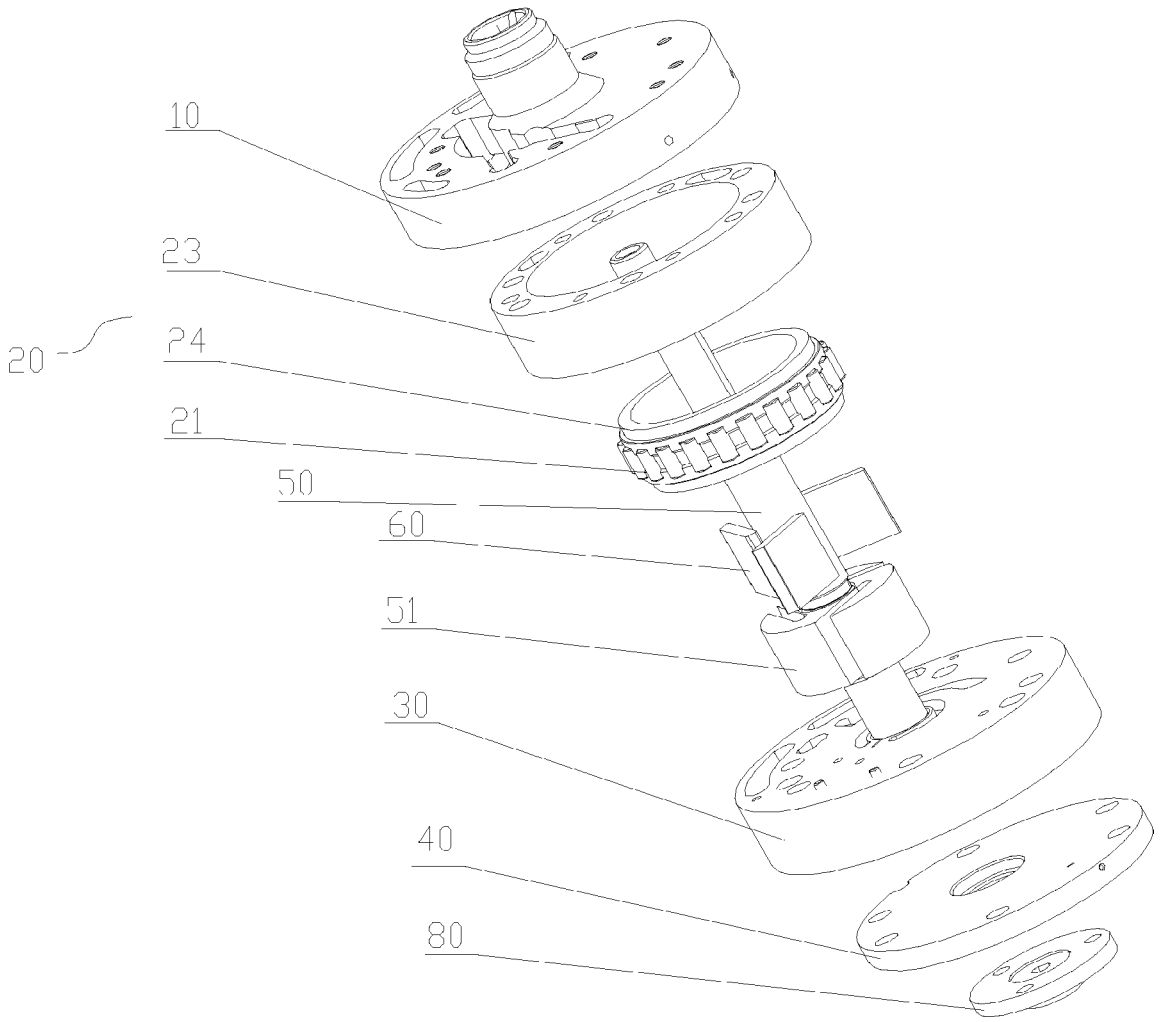
FIG. 1 shows a structural schematic diagram of a pumping assembly according to a specific embodiment of the present disclosure.
Figure 2:
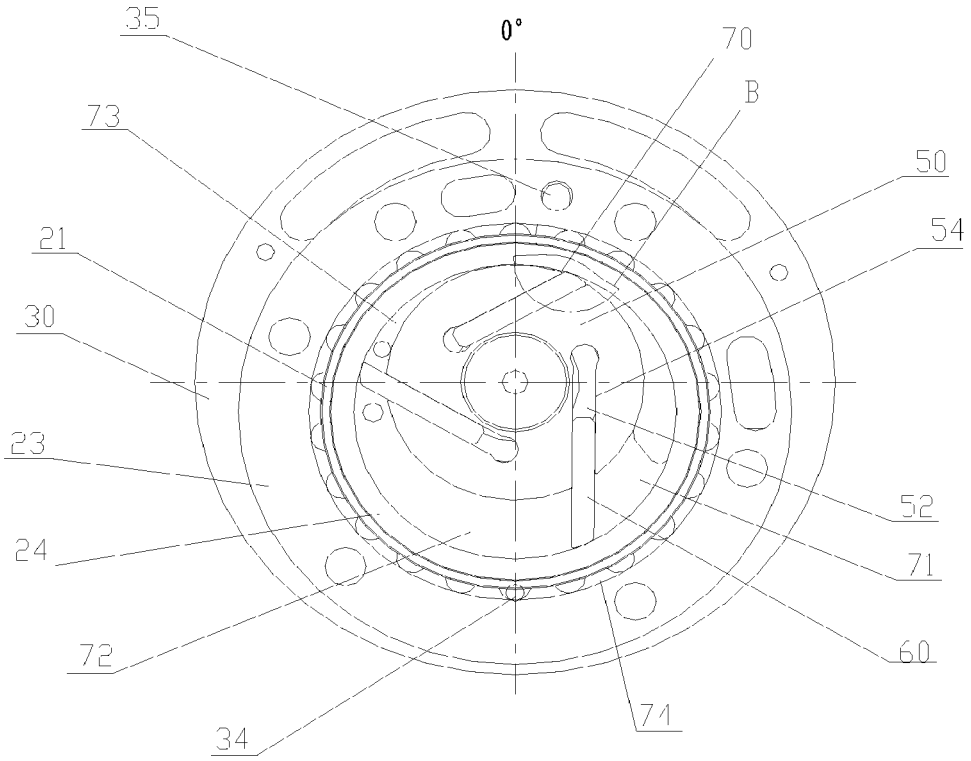
FIG. 2 shows atop view of a pumping assembly in FIG. 1.
Figure 3:
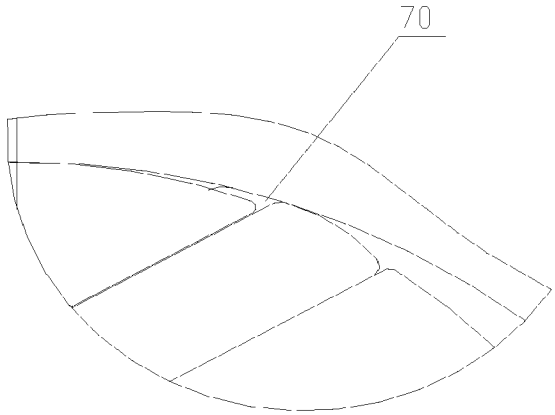
FIG. 3 shows an enlarged view of a part B in FIG. 2.

It should also be noted that the embodiments in the present disclosure and the features in the embodiments may be combined with each other on a non-conflict basis. The present disclosure will be described below in detail with reference to the accompanying drawings and in combination with the embodiments.

It should be noted that unless otherwise specified, all technical and scientific terms used herein have the same meaning as commonly understood by one of ordinary skill in the technical field to which the present disclosure belongs.

In the present disclosure, unless otherwise stated, directional words such as "upper, lower, top and bottom" are usually used for the directions shown in the drawings, or for the parts themselves in the vertical, perpendicular or gravity direction. Similarly, for convenience of understanding and description, "inside and outside" refer to inside and outside relative to the inside and outside of the parts themselves, but the above directional words are not used to limit the present disclosure.

To solve the problem in the prior art that the lubrication oil path of the pumping assembly cannot meet the lubrication requirement, the present disclosure provides a pumping assembly, a compressor and air conditioning equipment.

The air conditioning equipment includes the compressor. The compressor includes the following pumping assembly.

As shown in FIG. 1 to FIG. 12, the pumping assembly in the present disclosure includes a first structural body 10, a rolling bearing assembly 20, a second structural body 30, a third structural body 40 and a main shaft 50. The main shaft 50 sequentially passes through the first structural body 10, the rolling bearing assembly 20, the second structural body 30 and the third structural body 40. The pumping assembly includes a plurality of lubricating oil paths. The plurality of lubricating oil paths at least include: a first lubricating oil path, a second lubricating oil path and a third lubricating oil path. The first lubricating oil path passes through the second structural body 30, a sliding sheet backpressure cavity 52 of a rotor structure 51 of the main shaft 50, the third structural body 40, the second structural body 30 and a rolling body 21 of the rolling bearing assembly 20. The second lubricating oil path passes through the sliding sheet backpressure cavity 52 of the rotor structure 51 of the main shaft 50 and a first structural body pressure relieving groove 11 of the first structural body 10. The third lubricating oil path passes through the sliding sheet backpressure cavity 52 of the rotor structure 51 of the main shaft 50, the first structural body 10 and the rolling body 21 of the rolling bearing assembly 20.

An oil pump 80 is arranged on a lower part of the pumping assembly and is immersed in an oil pool 90 at the bottom of the compressor. When the pumping assembly with the above structure is used, the rolling bearing assembly 20 is arranged between the first structural body 10 and the second structural body 30, and lubricating oil paths capable of communicating the first structural body 10, the rolling bearing assembly 20, the second structural body 30 and the third structural body 40 are provided respectively, so that the lubrication and heat dissipation requirements of the pump body can be effectively met. Meanwhile, this arrangement also can provide stable backpressure to meet the lubrication requirements of various friction pairs.

In the specific implementation shown in FIG. 1, the first structural body 10 is located above the rolling bearing assembly 20. The second structural body 30 and the third structural body 40 are located below the rolling bearing assembly 20. Of course, a position relationship among the first structural body 10, the second structural body 30 and the third structural body 40 may be adjusted, the second structural body 30 and the third structural body 40 are arranged above the rolling bearing assembly 20, and the first structural body 10 is arranged below the rolling bearing assembly 20. Even if the position relationship among the first structural body 10, the second structural body 30 and the third structural body 40 is adjusted, it is also necessary to ensure that the first lubricating oil path, the second lubricating oil path and the third lubricating oil path meet the above route requirements. In this way, it can be ensured that the sliding sheet backpressure cavity 52 has sufficient backpressure, and the rolling body 21 is effectively lubricated.

Figure 4:
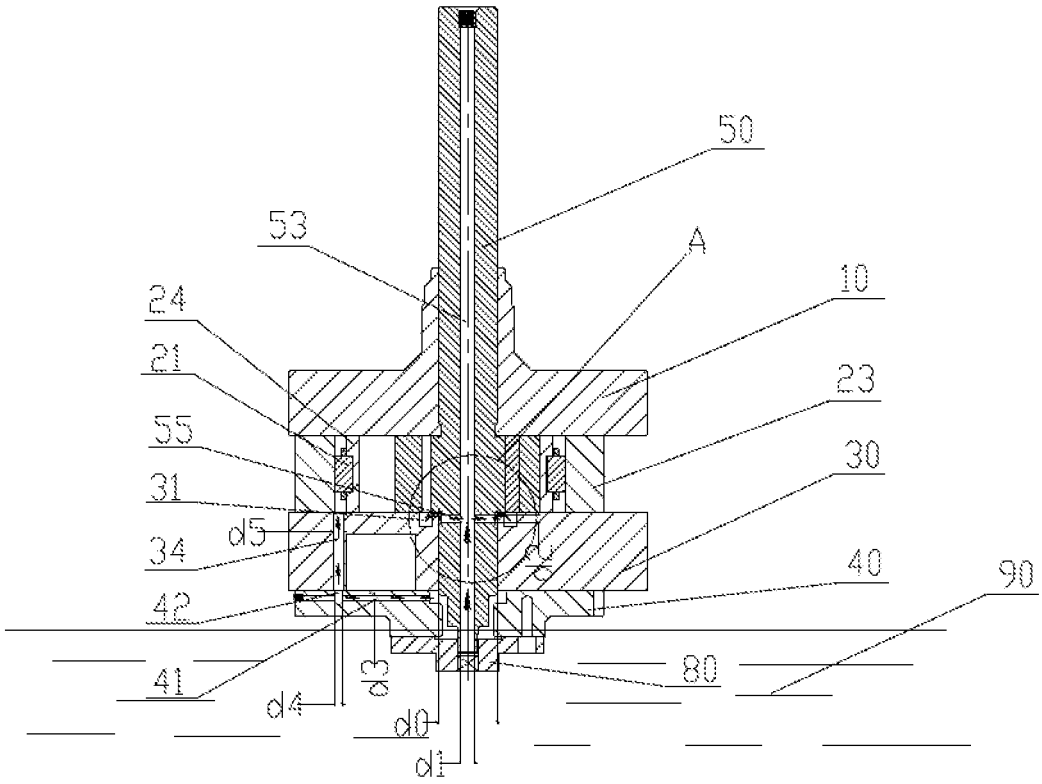
FIG. 4 shows a structural schematic diagram of a pumping assembly in FIG. 1 when the pumping assembly is in an oil pool.
Figure 5:
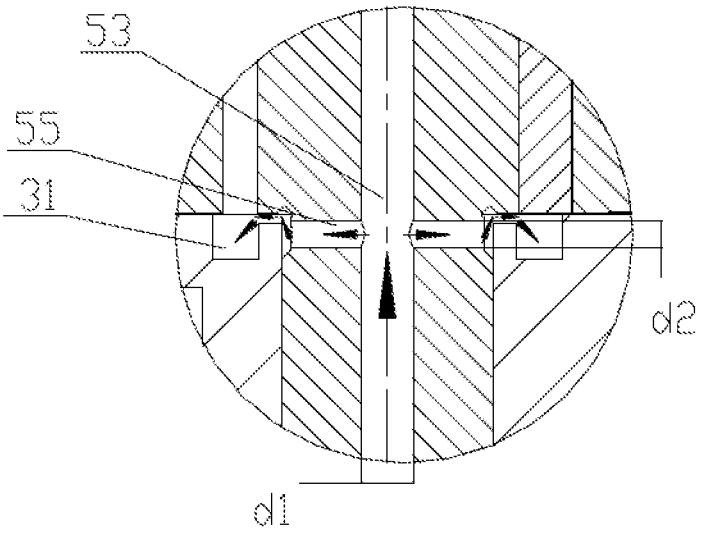
FIG. 5 shows an enlarged view of a part A in FIG. 4.
Figure 6:
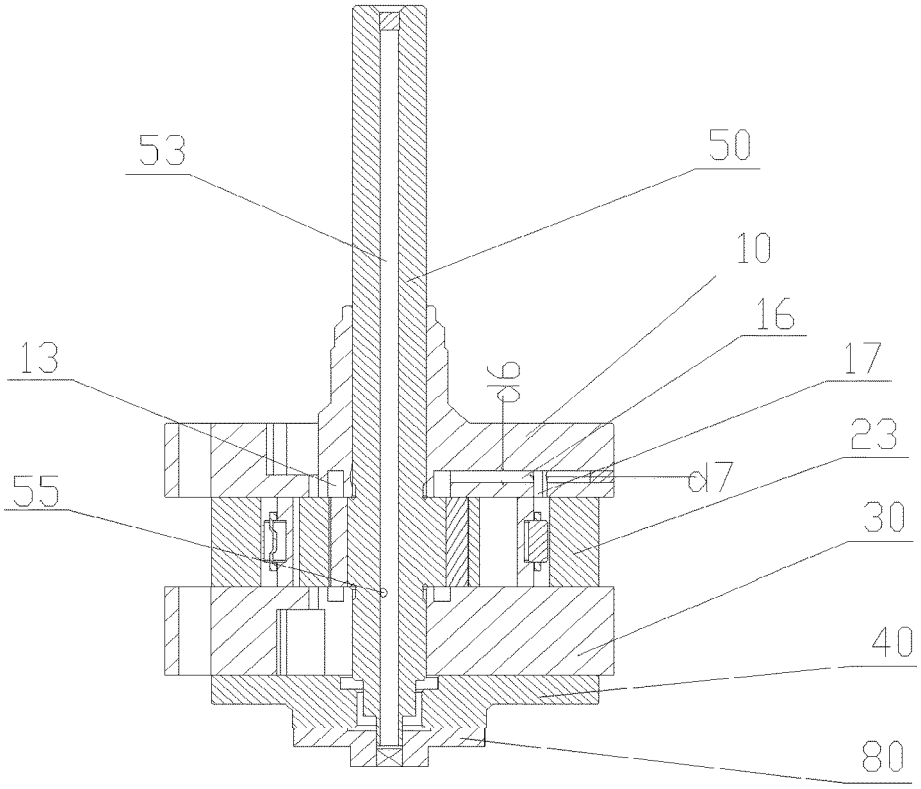
FIG. 6 shows a section view of a pumping assembly in FIG. 1.
Figure 7:
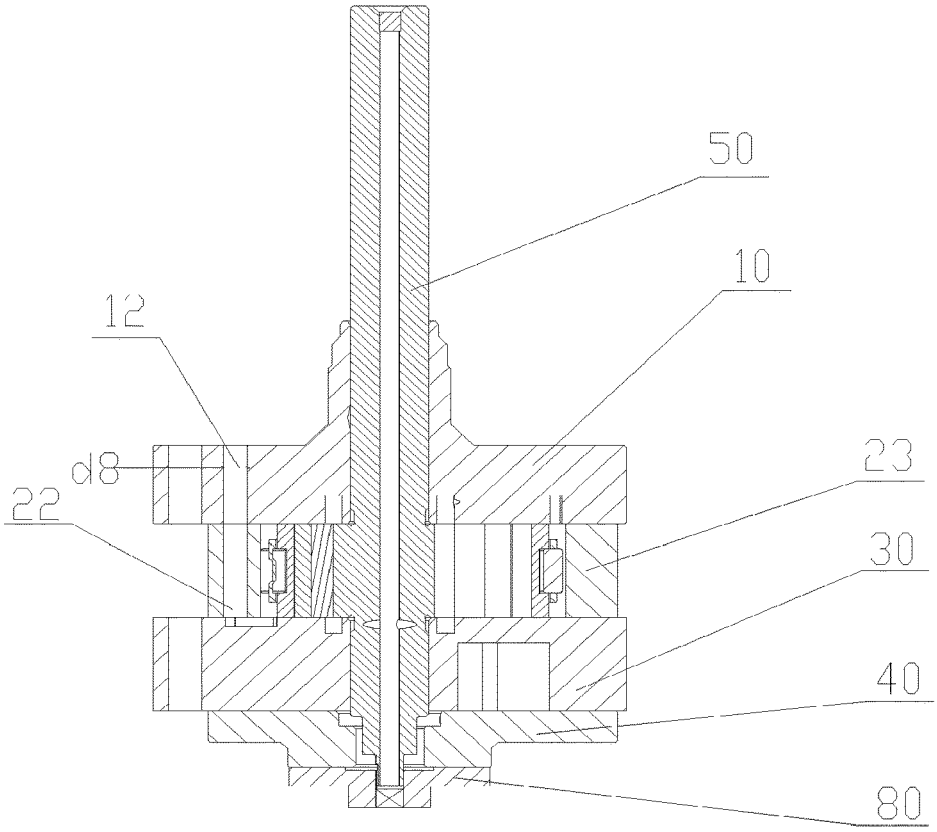
FIG. 7 shows a section view of a pumping assembly in FIG. 1 in another direction.
Figure 8:
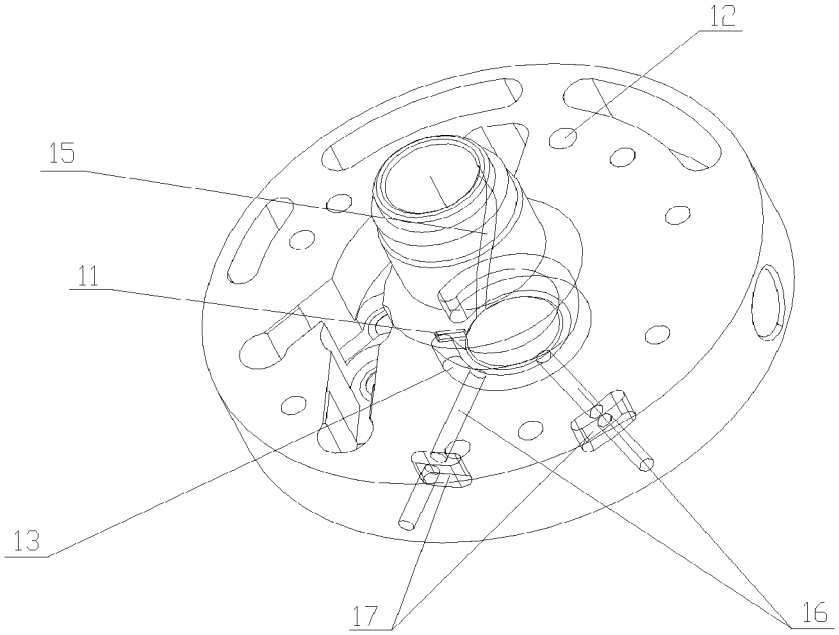
FIG. 8 shows a perspective drawing of an upper flange in a pumping assembly in FIG. 1.
Figure 9:
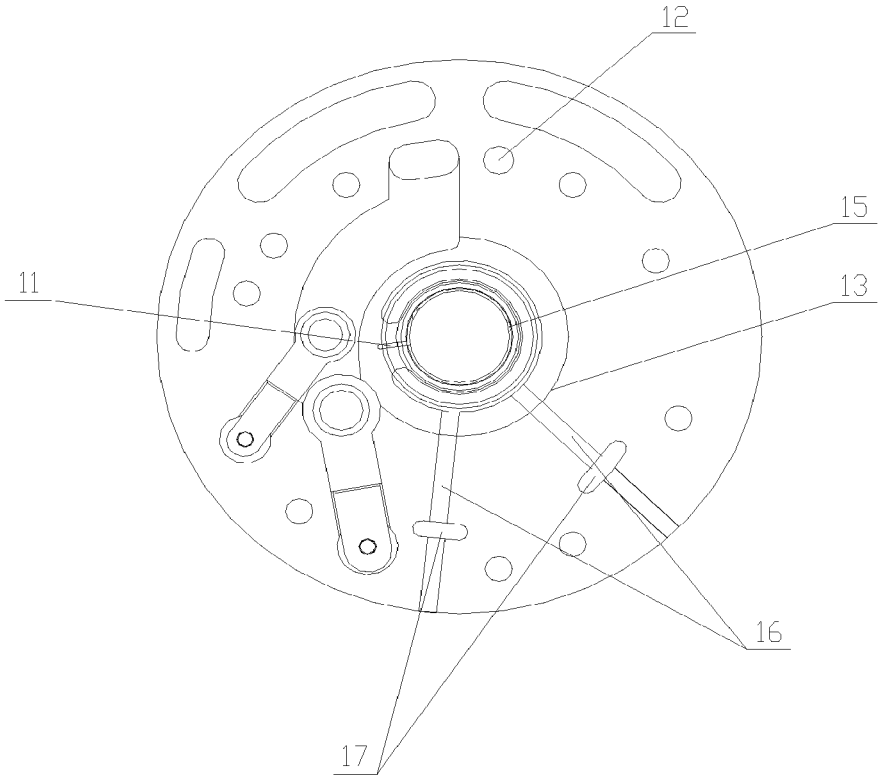
FIG. 9 shows a top view of an upper flange in a pumping assembly in FIG. 8.
Figure 10:
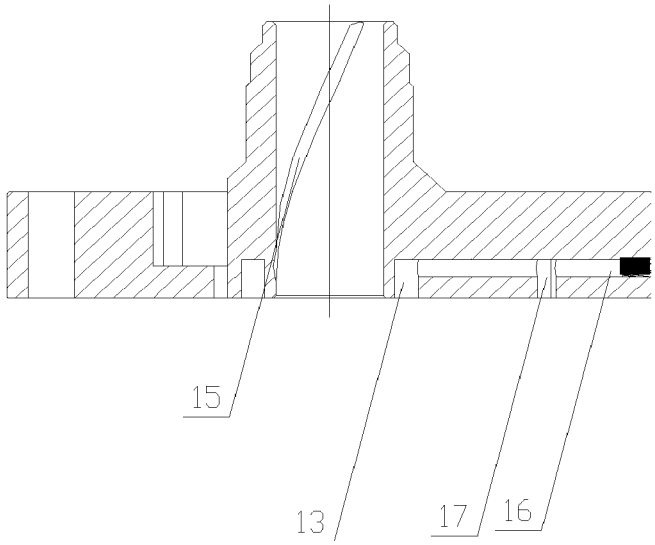
FIG. 10 shows a section view of an upper flange in a pumping assembly in FIG. 8.
Figure 11:
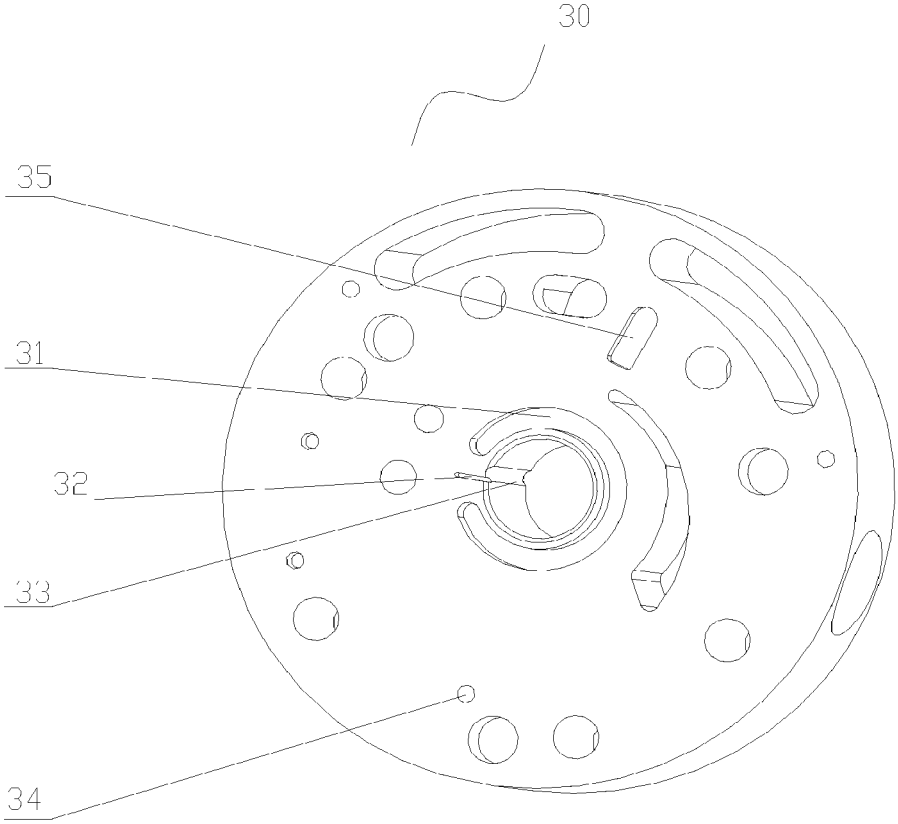
FIG. 11 shows a structural schematic diagram of a lower flange in a pumping assembly in FIG. 1.
Figure 12:
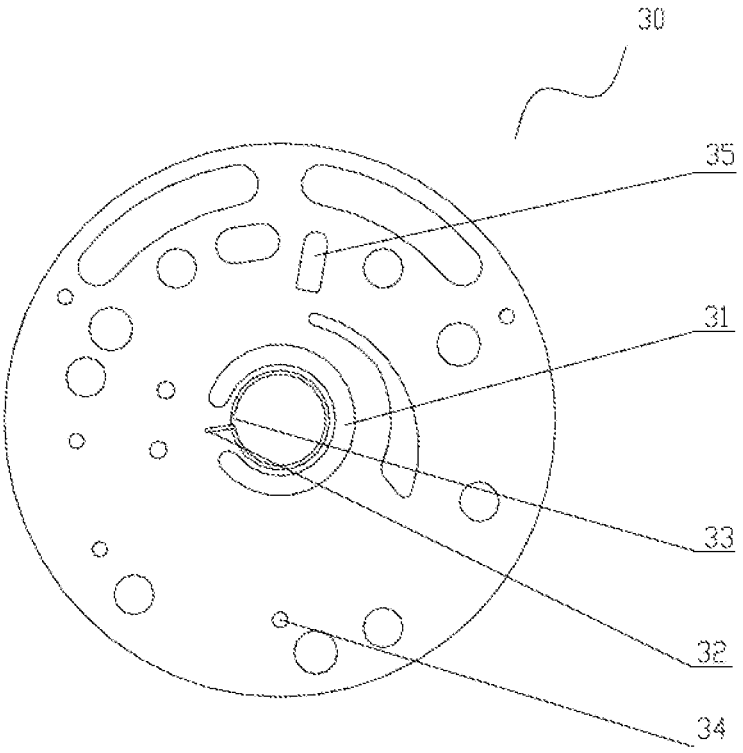
FIG. 12 shows a top view of a lower flange in a pumping assembly in FIG. 11.

As shown in FIG. 8 to FIG. 10, the first structural body 10 is provided with a first structural body pressure relieving groove 11, a first structural body first oil hole 12, a first structural body backpressure groove 13, a spiral groove 15, a first structural body second oil hole 16 and a first structural body third oil hole 17. As shown in FIG. 11 to FIG. 12, the second structural body 30 is provided with a second structural body backpressure groove 31, a second structural body pressure relieving groove 32, a second structural body first oil groove 33, a second structural body oil hole 34 and a second structural body second oil groove 35. As shown in FIG. 4, the third structural body 40 is provided with a third structural body first oil hole 41 and a third structural body second oil hole 42.

In this embodiment, the first lubricating oil path includes a main shaft center hole 53 of the main shaft 50, a main shaft oil hole 55 of the main shaft 50, a second structural body backpressure groove 31 of the second structural body 30, the sliding sheet backpressure cavity 52 of the rotor structure 51 of the main shaft 50, a second structural body pressure relieving groove 32 of the second structural body 30, a second structural body first oil groove 33 of the second structural body 30, a third structural body first oil hole 41 of the third structural body 40, a third structural body second oil hole 42 of the third structural body 40, a second structural body oil hole 34 of the second structural body 30, the rolling body 21 of the rolling bearing assembly 20, a second structural body second oil groove 35 of the second structural body 30, an outer ring oil hole 22 of the rolling bearing assembly 20 and a first structural body first oil hole 12 of the first structural body 10. Lubricating oil in the first lubricating oil path returns to an oil pool 90 from the first structural body first oil hole 12.

In this embodiment, the second lubricating oil path includes the main shaft center hole 53 of the main shaft 50, a main shaft oil hole 55 of the main shaft 50, a second structural body backpressure groove 31 of the second structural body 30, the sliding sheet backpressure cavity 52 of the rotor structure 51 of the main shaft 50, a first structural body backpressure groove 13 of the first structural body 10, a first structural body pressure relieving groove 11 of the first structural body 10 and a spiral groove 15 of the first structural body 10. Lubricating oil in the second lubricating oil path returns to an oil pool 90 from the spiral groove 15 of the first structural body 10.

In this embodiment, the third lubricating oil includes a main shaft center hole 53 of the main shaft 50, a main shaft oil hole 55 of the main shaft 50, a second structural body backpressure groove 31 of the second structural body 30, the sliding sheet backpressure cavity 52 of the rotor structure 51 of the main shaft 50, a first structural body backpressure groove 13 of the first structural body 10, a first structural body second oil hole 16 of the first structural body 10, a first structural body third oil hole 17 of the first structural body 10, the rolling body 21 of the rolling bearing assembly 20, a second structural body second oil groove 35 of the second structural body 30, an outer ring oil hole 22 of the rolling bearing assembly 20 and a first structural body first oil hole 12 of the first structural body 10. Lubricating oil in the third lubricating oil path returning to an oil pool 90 from the first structural body first oil hole 12.

Since there are overlapping parts in the flowing routes of the three lubricating oil paths, in the actual working process of the pumping assembly, the phenomenon that three lubricating oil paths overlap at some positions of the pumping assembly will occur.

In the specific embodiments shown in FIG. 1 to FIG. 12, the first structural body 10 is an upper flange, the second structural body 30 is a lower flange, and the third structural body 40 is a lower flange cover plate. As shown in FIG. 1, the pumping assembly mainly includes an upper flange, a bearing outer ring 23, a bearing inner ring 24, a rolling body 21, a sliding sheet 60, a main shaft 50, a lower flange, a lower flange cover plate and an oil pump 80. Moreover, the rolling bearing assembly 20 includes the bearing outer ring 23, the bearing inner ring 24 and the rolling body 21, an outer ring oil hole 22 of the rolling bearing assembly 20 is formed in the bearing outer ring, and the rolling body 21 is arranged at the circumferential periphery of the bearing inner ring 24. The main shaft 50 is provided with a rotor structure 51, the rotor structure 51 is provided with a sliding sheet groove 54, and the sliding sheet 60 is arranged on the sliding sheet groove 54 of the rotor structure 51 of the main shaft 50.

As shown in FIG. 1 to FIG. 7, when the compressor operates, with the rotation of the main shaft 50, the sliding sheet 60 extends out of the sliding sheet groove 54 under the action of a centrifugal force and backpressure and is in contact with an inner wall surface of the bearing inner ring 24. With the stable operation of the compressor, the sliding sheet 60 beings to reciprocate in the sliding sheet groove 54. Three sliding sheets 60 and the bearing inner ring 24 divide a crescent cavity integrally surrounded by the bearing inner ring 24 and the main shaft 50 into four independent chambers, that is, a first chamber 70, a second chamber 71, a third chamber 72 and a fourth chamber 73. When the head of one of the sliding sheets 60 is just located at 0°, the volume of the first chamber 70 is 0. These chambers are periodically enlarged and contracted so as to realize the suction and exhaust of the compressor. In the operating process of the compressor, the sliding sheet 60 and the sliding sheet groove 54 form a closed space, which is called the sliding sheet backpressure cavity 52. There are also three sliding sheet backpressure cavities 52, which are periodically enlarged and shrunk with the operation of the compressor.

As shown in FIG. 4 to FIG. 7, the main shaft 50 rotates to drive the oil pump 80 to rotate. The oil pump 80 is a positive displacement pump. Under the action of the oil pump 80, oil enters the main shaft center hole 53 from the oil pool 90. Oil enters the second structural body backpressure groove 31 through the main shaft oil hole 55 and fills the sliding sheet backpressure cavity 52. The first structural body backpressure groove 13 communicates with the second structural body back pressure groove 31 through the sliding sheet backpressure cavity 52. After the oil fills the sliding sheet backpressure cavity 52, the residual oil will further fill the second structural body backpressure groove 31 and enters a cavity 74 between the bearing inner ring 24 and the bearing outer ring 23 through the first structural body second oil hole 16 and the first structural body third oil hole 17 to lubricate the rolling body 21. When the sliding sheet backpressure cavity rotates by a certain angle and is separated from the second structural body backpressure groove 31 and the first structural body backpressure groove 13, the volume of the sliding sheet backpressure cavity 52 is continuously reduced, and oil discharged from the sliding sheet backpressure cavity 52 is discharged through the second structural body pressure relieving groove 32 and the first structural body pressure relieving groove 11 respectively. The oil discharged from the second structural body pressure relieving groove 32 sequentially passes through the second structural body first oil groove 33, the third structural body first oil hole 41, the third structural body second oil hole 42 and the second structural body oil hole 34 to enter the cavity 74 between the bearing inner ring 24 and the bearing outer ring 23. Oil in the cavity 74 passes through the second structural body second oil groove 35 to enter the outer ring oil hole 22 in the bearing outer ring 23 to be discharged out of the pump body through the first structural body first oil hole 12. Oil discharged from the first structural body pressure relieving groove 11 is discharged out of the pump body through the spiral groove 15 of the first structural body 10.

In some embodiments, a relationship between a diameter d0 of the main shaft 50 and a diameter d1 of the main shaft center hole 53 of the main shaft 50 satisfies: $0.2d0 \le d1 \le 0.5d0$.

In some embodiments, a relationship between a diameter d2 of the main shaft oil hole 55 the main shaft 50 and a diameter d1 of the main shaft center hole 53 of the main shaft 50 satisfies: $0.15d1 \le d2 \le 0.6d1$.

In some embodiments, a relationship among a diameter d1 of the main shaft center hole 53 of the main shaft 50, a diameter d3 of the third structural body first oil hole 41, a diameter d4 of the third structural body second oil hole 42 of the third structural body 40 and a diameter d5 of the second structural body oil hole 34 of the second structural body 30 satisfies: $0.1d1 \le d3 \le d4 \le d5 \le 0.3d1$.

In some embodiments, a relationship among a diameter d2 of the main shaft oil hole 55 of the main shaft 50, a diameter d6 of the first structural body second oil hole 16 of the first structural body 10 and a diameter d7 of the first structural body third oil hole 17 of the first structural body 10 satisfies: $0.3d2 \le d6 \le d7 \le d2$.

In some embodiments, a relationship among a diameter d3 of the third structural body first oil hole 41, a diameter d7 of the first structural body third oil hole 17 of the first structural body 10 and a diameter d8 of the first structural body first oil hole 12 of the first structural body 10 satisfies $0.125\ (d3^2+d7^2)^{0.5} \le d8 \le (d3^2+d7^2)^{0.5}$.

There are two main factors affecting the flow resistance in the flow path: linear loss and local resistance loss. In case of a smooth pipe, the linear loss may be ignored, the influence of the local resistance loss is mainly considered, and the change of a pipe diameter is the main influence factor of the local resistance loss. The local resistance loss $hj=\xi*v^2/(2*g)$, and the smaller the flow velocity, the smaller the resistance loss hj; and the smaller the local resistance loss coefficient ξ, the smaller the resistance loss hj, wherein v is the average velocity of fluid in the pipe, and g is the gravitational acceleration.

The limitation of the minimum size of the d1, d2, d3, d4, d5, d6, d7 and d8 may make the influence of the flow resistance of the oil path small and ensure the smoothness of the flow path. The limitation of the maximum size is mainly based on the consideration of the reliability of the bearing structure, and both requirements can be taken into consideration in the above-mentioned size range.

The d1, d2, d3, d4, d5, d6, d7 and d8 have the same size setting basis.

As shown in FIG. 4 to FIG. 7, by setting the size design of each oil hole of the oil path to meet the above requirement, the sliding sheet backpressure cavity 52 may in a full oil state, so that the oil pressure fluctuation of the sliding sheet backpressure cavity 52 may be effectively reduced, and the lubrication of each friction pair may be met. Correspondingly, the flow area corresponding to each oil path may be obtained as A1, A2, A3, A4, A5, A6, A7 and A8 through conversion of the hole diameter, the total flow area of the main shaft center hole 53 of the main shaft 50 is A1, the total flow area of the main shaft oil hole 55 of the main shaft 50 is A2, the total flow area of the third structural body first oil hole 41 is A3, the total flow area of the third structural body second oil hole 42 of the third structural body 40 is A4, the total flow area of the second structural body oil hole 34 of the second structural body 30 is A5, the total flow area of the first structural body second oil hole 16 of the first structural body 10 is A6, the total flow area of the first structural body third oil hole 17 of the first structural body 10 is A7, and the total flow area of the first structural body first oil hole 12 of the first structural body 10 is A8. In some embodiments, a ratio of the total flow area A6 of the first structural body second oil hole 16 of the first structural body 10 to the total flow area A3 of the third structural body first oil hole 41 satisfies $A6/A3 \ge 2.4$, wherein the performance is the best when $5 \le A6/A3 \le 10$, the evaluation index of the performance is COP, and COP=refrigerating capacity/power consumption.

Figure 13:
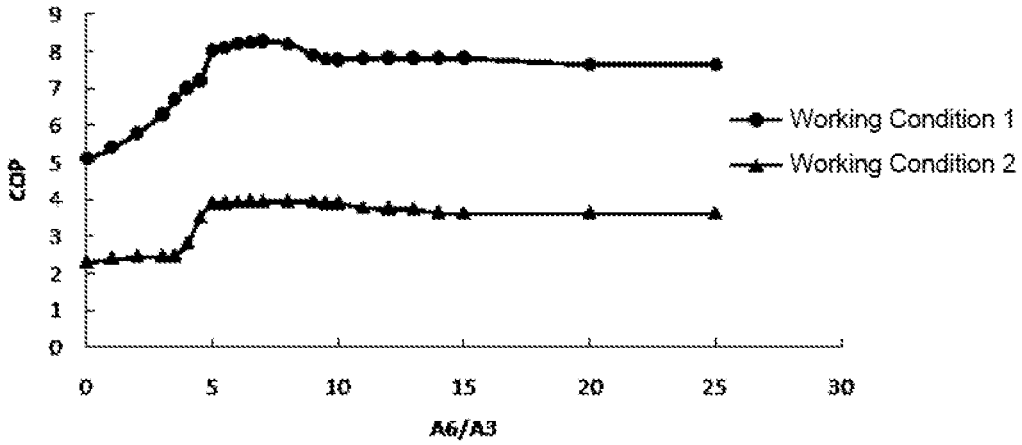
FIG. 13 shows a graph of a relationship between A6/A3 and COP of a pumping assembly in FIG. 1 under two different working conditions.

As shown in FIG. 13, it is a graph of a relationship between A6/A3 and COP under two different working conditions (working condition 1: intermediate working condition, that is, 50% rated condition; and working condition 2: rated condition). It can be seen from the figure that COP is the best when $5 \leq A6/A3 \leq 10$, that is, larger refrigerating capacity may be obtained on the premise of low power consumption.

Of course, the shape of the above oil hole is not limited to round, and may also be any irregular shape, as long as the equivalent area requirement of the oil hole can be met. By optimizing the oil path design of the compressor, there are three flow paths of oil to be set. By controlling the size of each oil hole, the requirement of oil supply for the tail of the sliding sheet is met firstly and stable backpressure is provided for the sliding sheet; meanwhile, the lubrication of each friction pair may be met, and the reliability of the compressor may be improved.

From the above description, it can be seen that the above embodiments of the present disclosure may achieve at least one of the following technical effects:

1. an effective lubricating oil is provided for each friction pair;
2. the backpressure requirement of the sliding sheet is met, and the lubrication and heat dissipation requirements of the pump body are met; and
3. the structure is simple and the effect is obvious.

Apparently, the above described embodiments are merely a portion rather than all of the embodiments of the present disclosure. All other embodiments made on the basis of the embodiments of the present disclosure by those of ordinary skill in the art without paying any creative effort shall be included in the protection scope of the present disclosure.

It should be noted that the terms used herein are merely used for describing the specific examples, but are not intended to limit exemplary implementation manners of the present disclosure. As used herein, the singular form is also intended to include the plural form unless otherwise indicated obviously from the context. Furthermore, it should be further understood that the terms "includes" and/or "including" used in this specification specify the presence of stated features, steps, operations, devices, components, and/or a combination thereof.

It should be noted that the terms "first", "second", and so on in the description and claims of the present disclosure and in the above accompanying drawings are intended to distinguish between similar objects but do not necessarily indicate a specific order or sequence. It should be understood that the data used in such a way may be exchanged under proper conditions to make it possible to implement the described implementation manners of the present disclosure in sequences except those illustrated or described herein.

The foregoing is merely illustrative of the preferred embodiments of the present disclosure and is not intended to limit the present disclosure, and various changes and modifications can be made to the present disclosure by those skilled in the art. Any modifications, equivalent substitutions, improvements, and the like made within the spirit and scope of the present disclosure should fall within the protection scope of the present disclosure.

The invention claimed is:

1. A pumping assembly, comprising a first structural body, a rolling bearing assembly, a second structural body, a third structural body and a main shaft, wherein the main shaft sequentially passes through the first structural body, the rolling bearing assembly, the second structural body and the third structural body, and the pumping assembly comprising a plurality of lubricating oil paths, wherein the plurality of lubricating oil paths are comprised of: a first lubricating oil path passing through the second structural body, a sliding sheet backpressure cavity of a rotor structure of the main shaft, the third structural body, the second structural body and a rolling body of the rolling bearing assembly; a second lubricating oil path passing through the sliding sheet backpressure cavity of the rotor structure of the main shaft and a first structural body pressure relieving groove of the first structural body; and a third lubricating oil path passing through the sliding sheet backpressure cavity of the rotor structure of the main shaft, the first structural body and the rolling body of the rolling bearing assembly.

2. The pumping assembly according to claim 1, wherein the first lubricating oil path comprises a main shaft center hole of the main shaft, a main shaft oil hole of the main shaft, a second structural body backpressure groove of the second structural body, the sliding sheet backpressure cavity of the rotor structure of the main shaft, a second structural body pressure relieving groove of the second structural body, a second structural body first oil groove of the second structural body, a third structural body first oil hole of the third structural body, a third structural body second oil hole of the third structural body, a second structural body oil hole of the second structural body, the rolling body of the rolling bearing assembly, a second structural body second oil groove of the second structural body, an outer ring oil hole of the rolling bearing assembly and a first structural body first oil hole of the first structural body, and the first structural body first oil hole is configured to allow lubricating oil in the first lubricating oil path return to an oil pool.

3. The pumping assembly according to claim 1, wherein the second lubricating oil path comprises a main shaft center hole of the main shaft, a main shaft oil hole of the main shaft, a second structural body backpressure groove of the second structural body, the sliding sheet backpressure cavity of the rotor structure of the main shaft, a first structural body backpressure groove of the first structural body, a first structural body pressure relieving groove of the first structural body and a spiral groove of the first structural body, and the spiral groove is configured to allow lubricating oil in the second lubricating oil path to return to an oil pool.

4. The pumping assembly according to claim 1, wherein the third lubricating oil path comprises a main shaft center hole of the main shaft, a main shaft oil hole of the main shaft, a second structural body backpressure groove of the second structural body, the sliding sheet backpressure cavity of the rotor structure of the main shaft, a first structural body backpressure groove of the first structural body, a first structural body second oil hole of the first structural body, a first structural body third oil hole of the first structural body, the rolling body of the rolling bearing assembly, a second structural body second oil groove of the second structural body, an outer ring oil hole of the rolling bearing assembly and a first structural body first oil hole of the first structural body, and the first structural body first oil hole is configured to allow lubricating oil in the third lubricating oil path return to an oil pool.

5. The pumping assembly according to claim 1, wherein the first structural body is located above the rolling bearing assembly, and the second structural body and the third structural body are located below the rolling bearing assembly; or the first structural body is located below the rolling bearing assembly, and the second structural body and the third structural body are located above the rolling bearing assembly.

6. The pumping assembly according to claim 1, wherein the first structural body is an upper flange, the second structural body is a lower flange, and the third structural body is a cover plate.

7. The pumping assembly according to claim 2, wherein a relationship between a diameter d0 of the main shaft and a diameter d1 of the main shaft center hole of the main shaft satisfies: $0.2d0 \leq d1 \leq 0.5d0$.

8. The pumping assembly according to claim 2, wherein a relationship between a diameter d2 of the main shaft oil hole of the main shaft and a diameter d1 of the main shaft center hole of the main shaft satisfies: $0.15d1 \leq d2 \leq 0.6d1$.

9. The pumping assembly according to claim 2, wherein a relationship among a diameter d1 of the main shaft center hole of the main shaft, a diameter d3 of the third structural body first oil hole of the third structural body, a diameter d4 of the third structural second oil hole of the third structural body and a diameter d5 of the second structural body oil hole of the second structural body satisfies:

$$0.1d1 \leq d3 \leq d4 \leq d5 \leq 0.3d1.$$

10. The pumping assembly according to claim 4, wherein a relationship among a diameter d2 of the main shaft oil hole of the main shaft, a diameter d6 of the first structural body second oil hole of the first structural body and a diameter d7 of the first structural body third oil hole of the first structural body satisfies: $0.3d2 \leq d6 \leq d7 \leq d2$.

11. The pumping assembly according to claim 4, wherein a relationship among a diameter d3 of a third structural body first oil hole of the third structural body, a diameter d7 of the first structural body third oil hole of the first structural body and a diameter d8 of the first structural body first oil hole of the first structural body satisfies:

$$0.125(d3\hat{}2+d7\hat{}2)\hat{}0.5 \leq d8 \leq (d3\hat{}2+d7\hat{}2)\hat{}0.5.$$

12. A compressor, comprising the pumping assembly according claim 1.

13. Air conditioning equipment, comprising the compressor according to claim 12.

14. The pumping assembly according to claim 3, wherein a relationship between a diameter d0 of the main shaft and a diameter d1 of the main shaft center hole of the main shaft satisfies: $0.2d0 \leq d1 \leq 0.5d0$.

15. The pumping assembly according to claim 4, wherein a relationship between a diameter d0 of the main shaft and a diameter d1 of the main shaft center hole of the main shaft satisfies: $0.2d0 \leq d1 \leq 0.5d0$.

16. The pumping assembly according to claim 3, wherein a relationship between a diameter d2 of the main shaft oil hole of the main shaft and a diameter d1 of the main shaft center hole of the main shaft satisfies: $0.15d1 \leq d2 \leq 0.6d1$.

17. The pumping assembly according to claim 4, wherein a relationship between a diameter d2 of the main shaft oil hole of the main shaft and a diameter d1 of the main shaft center hole of the main shaft satisfies: $0.15d1 \leq d2 \leq 0.6d1$.

* * * * *